US011683647B2

(12) United States Patent
Herger

(10) Patent No.: US 11,683,647 B2
(45) Date of Patent: Jun. 20, 2023

(54) ELECTRODYNAMIC DRIVE FOR FLAT LOUDSPEAKER SYSTEMS

(71) Applicant: Sotis AG, Altdorf (CH)

(72) Inventor: Danilo Herger, Burglen (CH)

(73) Assignee: Sotis AG

( * ) Notice: Subject to any disclaimer, the term of this patent is extended or adjusted under 35 U.S.C. 154(b) by 104 days.

(21) Appl. No.: 17/421,623

(22) PCT Filed: Aug. 17, 2020

(86) PCT No.: PCT/IB2020/057720

§ 371 (c)(1),
(2) Date: Jul. 8, 2021

(87) PCT Pub. No.: WO2022/023803

PCT Pub. Date: Feb. 3, 2022

(65) Prior Publication Data

US 2022/0345822 A1 Oct. 27, 2022

(30) Foreign Application Priority Data

Jul. 29, 2020 (RU) ..... RU2020125147

(51) Int. Cl.

| | |
|---|---|
| ***H04R 7/04*** | (2006.01) |
| ***H04R 9/02*** | (2006.01) |
| ***H04R 9/04*** | (2006.01) |

(52) U.S. Cl.
CPC ..... *H04R 7/04* (2013.01); *H04R 9/025* (2013.01); *H04R 9/041* (2013.01)

(58) Field of Classification Search
CPC ..... H04R 9/025; H04R 7/04; H04R 9/041; H04R 9/06
See application file for complete search history.

(56) References Cited

U.S. PATENT DOCUMENTS 2,502,853 A * 4/1950 Keddie ..... H04R 7/12 181/164
5,848,174 A * 12/1998 Ki ..... H04R 9/043 381/403
2009/0141916 A1* 6/2009 Clair ..... H04R 7/04 381/182

FOREIGN PATENT DOCUMENTS

CN 105706465 A * 6/2016 ..... H04R 1/02
RU 2010130430 A 2/2012

* cited by examiner

*Primary Examiner* — Sunita Joshi

(57) ABSTRACT

Electrodynamic drive for a flat loudspeaker having an enclosure where the following components are installed: a magnetic system, a cylindrical coil fixed to the frame, a sound-emitting membrane attached to the cylindrical coil former, a system holding the coil within a magnetic gap, and flexible wires for supplying an electrical signal to the coil. While the magnetic system is made as a cylindrical permanent magnet, a ferrite ring with the above mentioned cylindrical magnet and washers, joining them into a single structure.

5 Claims, 4 Drawing Sheets

ELECTRODYNAMIC DRIVE FOR FLAT LOUDSPEAKER SYSTEMS

CROSS REFERENCE TO RELATED APPLICATIONS

This application is a National Stage Application of PCT/IB2020/057720 filed Aug. 17, 2020, which claims priority from Russian Patent Application No. 2020125147 filed on Jul. 29, 2020. The priority of said PCT and Russian Patent Application are claimed. Each of the prior mentioned applications is hereby incorporated by reference herein in its entirety.

FIELD OF THE INVENTION

The proposed technical solution relates to acoustics. It is an electrodynamic drive for flat-type loudspeaker systems.

BACKGROUND OF THE INVENTION

A wide range of industrially produced electrodynamic drives for flat acoustic systems are known produced by different companies: Dayton BST, Monacor, Visatone, Mechakustik, etc. Such loudspeakers are usually designed to operate in the mid- and high-frequency range. The lower cutoff frequency of most loudspeakers rarely extends below 100 Hz. Less common are loudspeakers that can provide an operating range 50 Hz-10 kHz in a finished loudspeaker system within. Among industrially manufactured products, there was no such exciter that would provide a full spectrum of audible acoustic radiation (20 Hz-20,000 Hz). As a result, commercially available electrodynamic exciters from many manufacturers are unsuitable for creating a full-range flat-type loudspeaker system. Frequency range of such exciters brings with it the necessity to take various measures to ensure the expansion of the acoustic system's frequency range: e.g. creating multi-band systems where the expansion of the lower and upper cutoff frequencies range is achieved by using additional acoustic links, including complex acoustic filter systems, or the using additional electrodynamic exciters, designed for operation in a narrow upper or lower register acoustic range.

Among other problems caused by the use of conventional acoustic vibration exciters for flat acoustic systems design is their low electrical power. As a result, to create a high-power acoustic system suitable for a professional environment, one needs to make a compromise: to create an assembly of several acoustic exciters within one sound-emitting membrane's area, which entails modulation-amplitude distortion of the sound signal, which degrades the loudspeaker's acoustic qualities.

It goes without saying that the solution of these technical problems with such complex and cumbersome means is impractical and is associated with increased material, time, and labor costs.

One of the closest analogous technical solutions is presented in the patent of the Russian Federation No. 2456764 dated Feb. 10, 2012, describing a flat loudspeaker. This flat loudspeaker is made in the form of an enclosure where the following components are installed: a magnetic system, a cylindrical coil fixed to the frame, a sound-emitting membrane attached to the cylindrical coil former, a system holding the coil within a magnetic gap, and flexible wires for supplying an electrical signal to the coil. The disadvantages of this device are insufficiently wide operating range and electrical power.

SUMMARY OF THE INVENTION

The technical result is expanding the operating range of the loudspeaker.

The technical result is achieved by the broad-band flat loudspeaker having an enclosure where the following components are installed: a magnetic system, a cylindrical coil fixed to the frame, a sound-emitting membrane attached to the cylindrical coil former, a system holding the coil within a magnetic gap, and flexible wires for supplying an electrical signal to the coil. Besides:

the magnetic system is made as a cylindrical permanent magnet, a ferrite ring with the above mentioned cylindrical magnet and washers, joining them into a single structure.

the cylindrical coil fixed to the frame is located above the cylindrical magnet and in the gap between the cylindrical magnet and the ferrite ring, the system holding the coil within a magnetic gap consists of two centering washers of different diameters fixed at some distance from each other, as concentrically corrugated discs, with an inner hole attached to the coil, and with an outer perimeter—to the body, and flexible wires supplying an electrical signal to the coil are sewn into one of the centering washers and are soldered at one end to the coil terminals, and the other one—to the outer contact group.

The centering washers are made of untreated fabric or other material suitable for this.

BRIEF DESCRIPTION OF THE DRAWINGS

The invention is illustrated by figures.

The figures indicate.

1. Enclosure,
2. Permanent cylindrical magnet,
3. Ferrite ring,
4. Steel washer,
5. System holding the coil within a magnetic gap, consisting of two centering washers of different diameters,
6. Wires supplying an electrical signal to the coil,
7. Ring,
8. Contacts,
9. Cylindrical coil,
10. Sound-emitting membrane.

DETAILED DESCRIPTION

Figure 1:
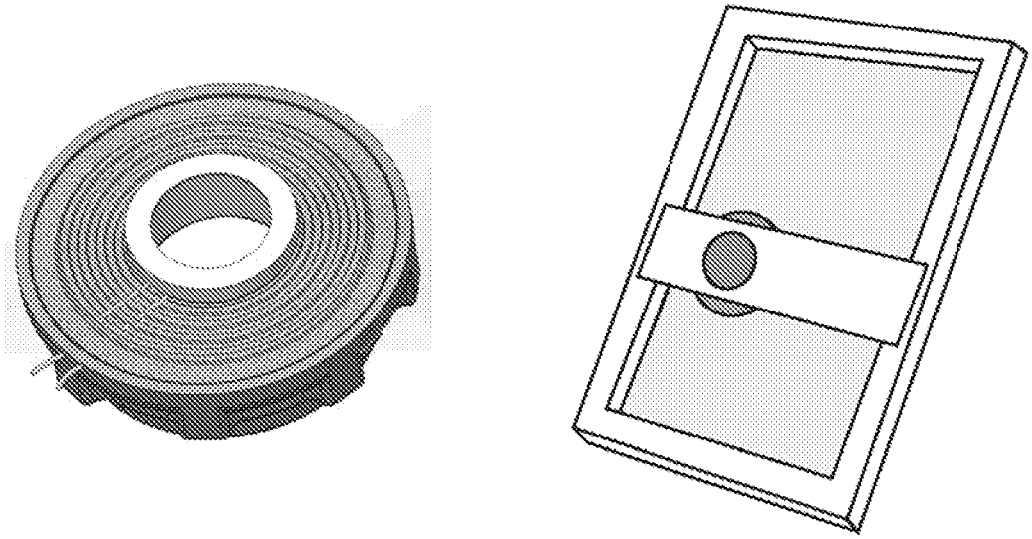
FIG. 1 demonstrates an overview of the proposed electrodynamic drive, and an example of its application in a flat loudspeaker.

The proposed electrodynamic drive for flat loudspeakers is a device for converting the electrical signal from the power amplifier into the mechanical energy of vibrations of the corresponding frequencies, exciting a resonating type sound-emitting membrane; its application in a flat loudspeaker is demonstrated in FIG. 1.

Figure 2:
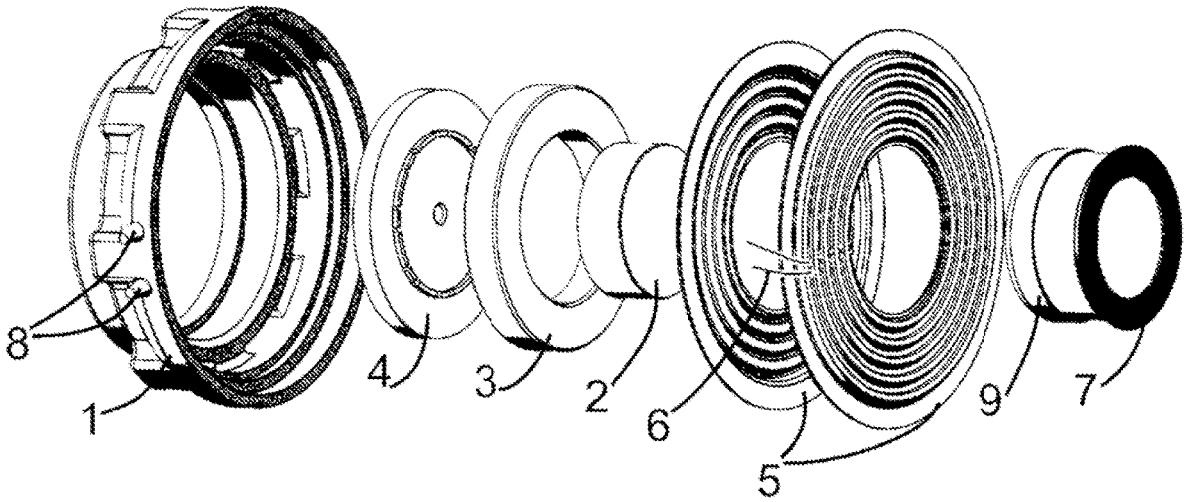
FIG. 2 demonstrates a disassembled electrodynamic drive.
Figure 3:
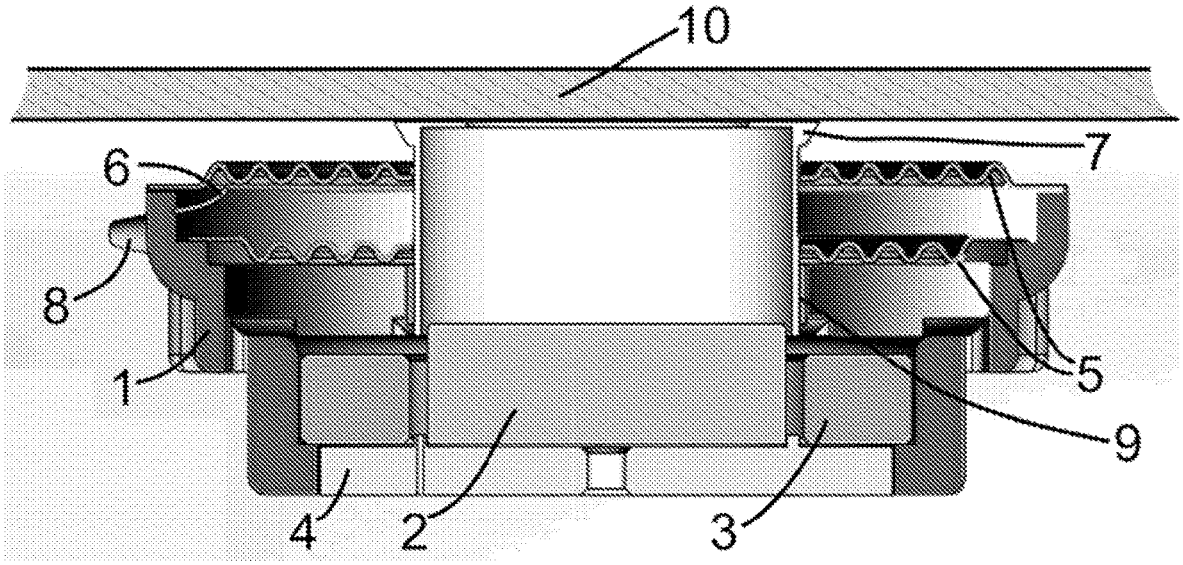
FIG. 3 demonstrates an electrodynamic drive for a flat loudspeaker.
Figure 4:
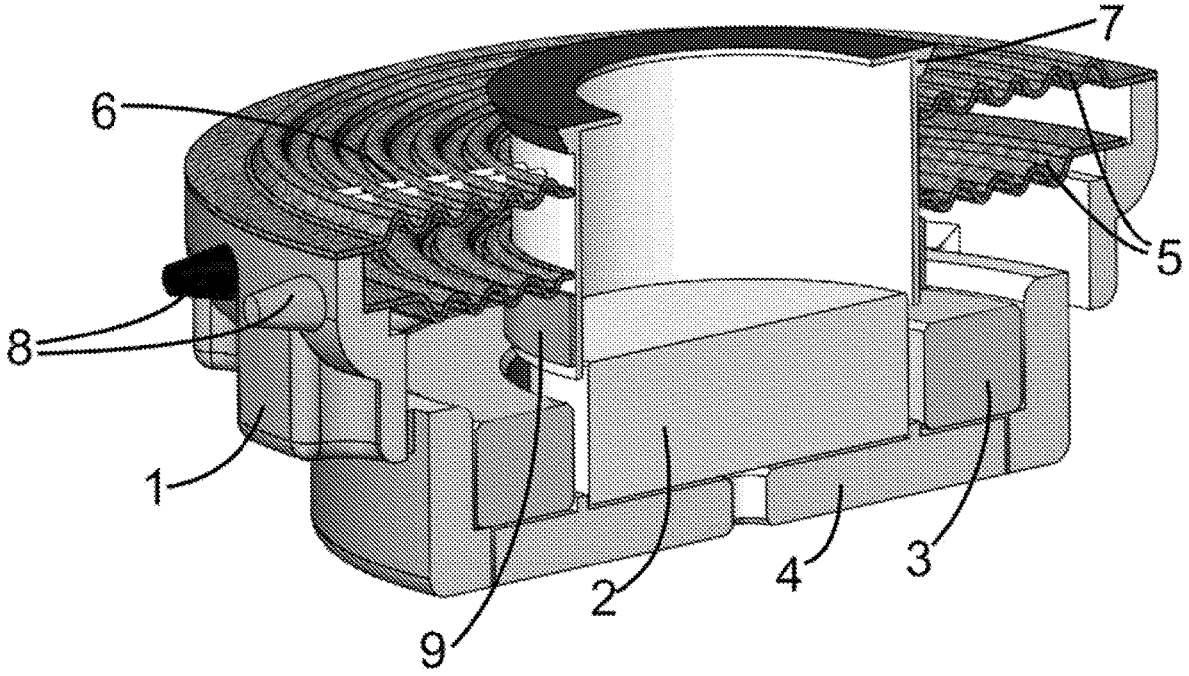
FIG. 4 demonstrates an electrodynamic drive in 3D with a section.

The device is demonstrated in FIGS. 2-4 and consists of:

- a plastic enclosure 1, acting as a support, to which a magnetic system is attached, a system holding a coil in a magnetic gap, mountings to a support frame made as a series of threaded holes;

parts of the magnetic system, including a cylindrical permanent magnet 2 (NeFeB), a ferrite ring 3, forming the outer perimeter of the annular space of the magnetic system, and a steel washer 4 that joins them together into a single structure;

a cylindrical coil 9 wound with copper wire and fixed to the cylindrical frame made of textolite or other material;

a system holding the coil within a magnetic gap 5 for ensuring its free reciprocating movement, consisting of two centering washers of different diameters fixed at some distance from each other (in practice, the distance is from 5 to 15 mm) and made of untreated fabric by pressing in the form of concentrically corrugated discs, with an inner hole fixed to the spool, and the outer perimeter to the support frame;

flexible wires supplying an electrical signal to the coil 6, sewn into one of the centering washers and soldered at one end to the coil terminals, and the other one—to the outer contact group for supplying an electrical signal from the amplifier;

ring 7 for fastening the coil former to the surface of the sound-emitting membrane 10;

contacts 8 for electrical signal supply.

This exciter's distinctive feature is the use of a ring made of ferrite material (ferrite ring) in the magnetic circuit. This material has a high magnetic permeability, despite the fact that its electrical conductivity is quite low. This property does not allow Foucault currents to be induced when the magnetic lines of the moving coil are crossed in the thickness of the magnetic circuit substance. The absence of back-EMF caused by this effect gives a high efficiency of the electrodynamic exciter in the lower frequencies register (about tens of hertz), when the coil vibrations amplitude becomes larger. The higher the movement speed of the magnetic lines crossing the body of the magnetic circuit, the more tangible Foucault currents will oppose the vector of application of the force that generates this speed. Thus, if a steel magnetic circuit is used, as is usually accepted, then the moving coil will "stick" in the opposing magnetic field under the influence of its own motion in the magnetic gap. Using ferrite as a magnetic circuit material leads to such a useful acoustic effect as an increase in efficiency, especially in a low frequency range, which in turn entails the possibility of a significant expansion of the device's operating range, up to the lower limit of audibility of 20 Hz.

The magnetic circuit of the proposed electrodynamic drive is composite and includes three parts: a permanent magnet of cylindrical or other shape 2, a steel washer 4 and a ferrite ring 3.

Using two centering washers of different diameters is a means of achieving the following technical result: a decrease in pronounced mechanical resonance at a certain frequency, which coincides with the frequency of the washers' own resonance. Washers with different geometrical parameters and rigidity will have two different frequencies of resonance excitation. As a result of this technical solution, the amplitude-frequency response graph of a loudspeaker equipped with such a drive smoothes out the frequency ejection corresponding to the excitation frequency of the described parts with a significant decrease in amplitude. As a result, the quality of the sound characteristics improves.

As a result: a loudspeaker equipped with a membrane reproduces a broad-spectrum acoustic signal; no signal filtering tools required; requires a two-channel power amplifier instead of a multi-channel one; reduced size of the product while maintaining consumer qualities; objective quality control parameters of the acoustic system (amplitude-frequency diagram, analysis graph of spectral-frequency magnitude, (spectral signal density), directional diagram of sound signal emission, measurements of phase nonlinear distortions . . . ) demonstrate noticeable advantages over the other acoustic systems. This makes the products equipped with the proposed broadband flat loudspeaker fully suitable for use in sound technology with increased demands on the sound reproduction quality. Including such a "challenging" area as the sound systems for classical music concerts.

The invention claimed is:

1. An electrodynamic drive for flat loudspeaker systems comprising:

a cylindrical enclosure with an opening at a first end, said enclosure having disposed therein a magnetic system, and a cylindrical coil having a first end proximate the enclosure opening, and a second end;

a membrane located proximate the enclosure opening and attached to the cylindrical coil through said enclosure opening; and flexible wires coupling the cylindrical coil to external contact terminals, wherein the flexible wires are adapted to supply an electrical signal to the cylindrical coil received from the contact terminals, wherein the magnetic system comprises:

a cylindrical permanent magnet disposed proximate the cylindrical coil second end;

a ferrite ring coaxially surrounding the cylindrical permanent magnet with a cylindrical gap formed therebetween;

and two centering washers in the form of concentrically flexible corrugated disks and fixed at a predetermined distance from each other, each washer having a. center hole for attaching to the cylindrical coil extending therethrough, and respective outer perimeters attached to the enclosure; and wherein a perimeter of the cylindrical coil at its second end is coaxially located proximate the gap between the cylindrical magnet and the ferrite ring.

2. An electrodynamic drive for flat loudspeaker systems according to claim 1, wherein the centering washers made of untreated fabric.

3. An electrodynamic drive for flat loudspeaker systems according to claim 1, wherein the membrane attached to the cylindrical coil by an intermediate ring.

4. An electrodynamic drive for flat loudspeaker systems comprising:

a cylindrical enclosure with an opening at a first end, said enclosure having disposed therein a magnetic system, and a cylindrical coil having a first end proximate the enclosure opening, and a second end;

a membrane located proximate the enclosure opening and attached to the cylindrical coil through said enclosure opening; and flexible wires coupling the cylindrical coil to external contact terminals, wherein the flexible wires are adapted to supply an electrical signal to the cylindrical coil received from the contact terminals, wherein the magnetic system comprises:

a cylindrical permanent magnet disposed proximate the cylindrical coil second end;

a ferrite ring coaxially surrounding the cylindrical permanent magnet with a cylindrical gap formed therebetween; and two centering washers in the form of concentrically flexible corrugated disks and fixed at a predetermined distance from each other, each washher having a center hole for attaching to the cylindrical coil extending therehrough, and respective outer perimeters attached to the enclosure, wherein a perimeter of the cylindrical coil at its second end is coaxially located proximate the gap between the cylindrical magnet and the ferrite ring, and wherein the centering washers made of untreated fabric, and wherein the flexible wires are sewn into the fabric of the centering washer proximate the membrane.

5. An electrodynamic drive for flat loudspeaker systems according to claim 1, wherein the two centering washers have different diameters.

* * * * *